US006290413B1

(12) United States Patent
Wang

(10) Patent No.: US 6,290,413 B1
(45) Date of Patent: Sep. 18, 2001

(54) WRITING INSTRUMENT

(76) Inventor: Wen-Yi Wang, No. 112, Sec. 3, Min Chuan Rd., Tainan (TW)

( * ) Notice: Subject to any disclaimer, the term of this patent is extended or adjusted under 35 U.S.C. 154(b) by 0 days.

(21) Appl. No.: 09/695,585

(22) Filed: Oct. 24, 2000

(51) Int. Cl.[7] ..... B43K 27/00
(52) U.S. Cl. ..... 401/30; 401/32
(58) Field of Search ..... 401/29–32, 82–84, 401/16, 19, 20, 22, 34

(56) References Cited

U.S. PATENT DOCUMENTS 1,679,382 * 8/1928 Sjobring ..... 401/82
2,710,614 * 6/1955 Dulberg ..... 401/30
5,577,850 * 11/1996 Mishima ..... 401/83

* cited by examiner

*Primary Examiner*—David J. Walczak
*Assistant Examiner*—Tuan Nguyen
(74) *Attorney, Agent, or Firm*—Hedman & Costigan P.C.

(57) ABSTRACT

A writing instrument includes a hollow barrel having a longitudinal slot defined through the barrel. The slot has two sides, and a series of continual indentations are formed in each side. A connecting device is slidably mounted in the barrel. A thrust device is mounted on the periphery of the barrel to drive the connecting device. The connecting device includes two opposite ends with a hollow, cylindrical connector attached to each end to connect to a crayon, a colored pencil or an eraser stick. Consequently, the writing instrument is easy to operate, never dirties the user's hands and can be used as an eraser or a double-color drawing pen.

4 Claims, 4 Drawing Sheets

WRITING INSTRUMENT

BACKGROUND OF THE INVENTION

1. Field of the Invention

The present invention relates to a writing instrument, and more particularly to a writing instrument that has at least one changeable writing implement. The changeable writing implement may be a colored pencil, a crayon or an eraser stick.

2. Description of Related Art

A child frequently uses a crayon to draw. A conventional crayon is a stick of colored wax with a paper cover on the outside crayon to prevent the crayon from getting the user's hand dirty. The user must tear off the paper on the crayon to expose the crayon after it has been used for a period of time.

However, the crayon is soft and only covered by a piece of paper so the crayon is easily broken during use. The length of exposed crayon is difficult to control especially when a child tears the paper off of the crayon. Sometimes the exposed section of crayon is too long and sometimes too short, which makes using the conventional crayon very inconvenient. Furthermore, as the crayon becomes shorter and is hard for the user to hold, the short crayon will be thrown out so that the crayon cannot be completely used.

Consequently, to overcome the disadvantages of the conventional crayon, the conventional crayon was covered by a tube of paper to prevent the conventional crayon from breaking during use. The roll of paper can be torn off in segments to control the exposed length of the crayon, but the crayon still cannot be completely used.

The present invention has arisen to mitigate and/or obviate the disadvantages of the conventional crayon.

SUMMARY OF THE INVENTION

In accordance with one aspect of the present invention, a writing instrument includes a hollow barrel having a longitudinal slot defined in the barrel and extending through the barrel. A series of continual corresponding indentations are formed on each side of the slot. A connecting device is slidably mounted in the barrel. A thrust device is mounted on the periphery of the barrel to drive the connecting device. A connector is attached to each end of the connecting device to attach a crayon, a colored pencil or an eraser.

Further benefits and advantages of the present invention will become apparent after a careful reading of the detailed description with appropriate reference to the accompanying drawings.

DETAILED DESCRIPTION OF THE INVENTION

Figure 1:
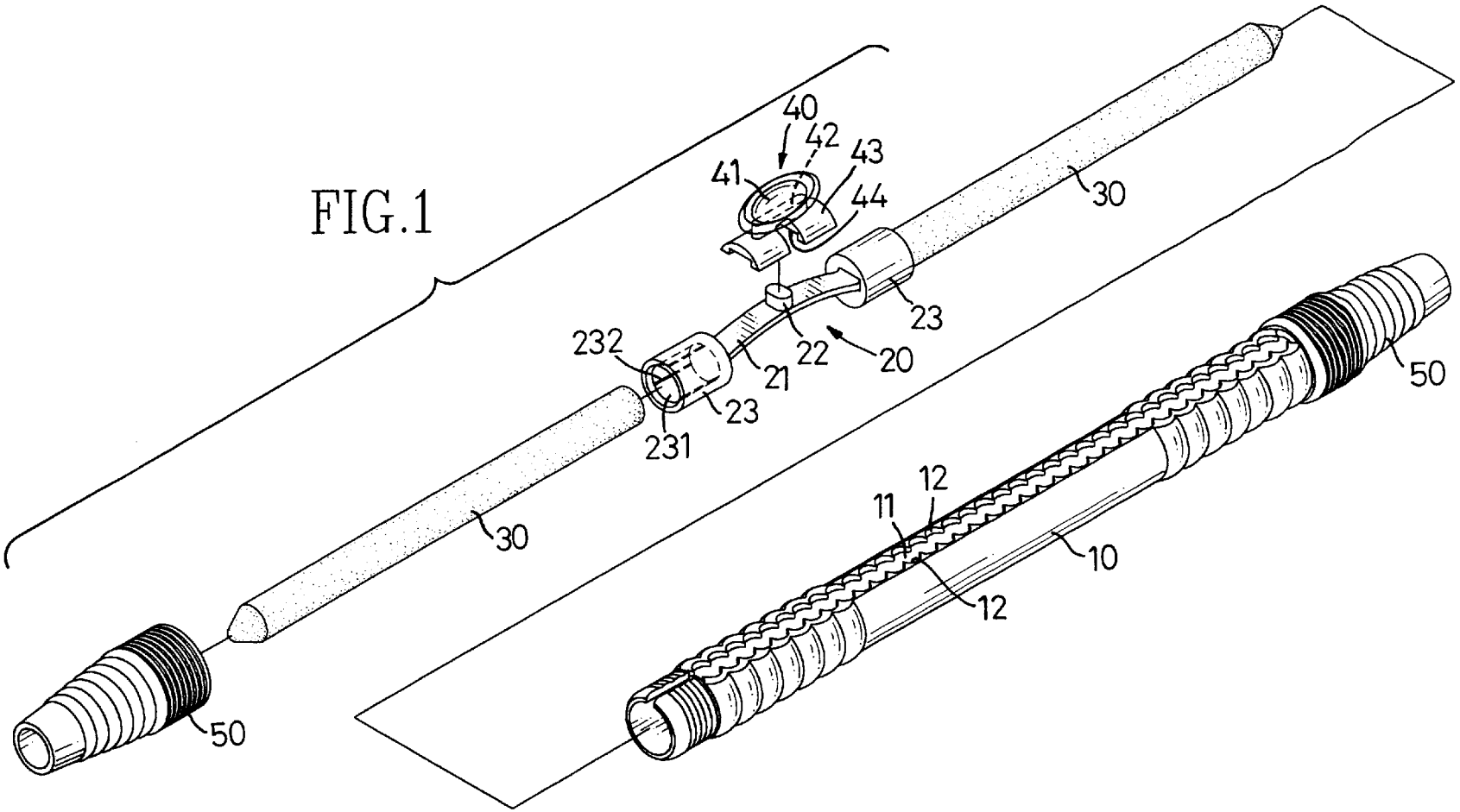
FIG. 1 is an exploded perspective view of a writing instrument in accordance with the present invention.
Figure 2:
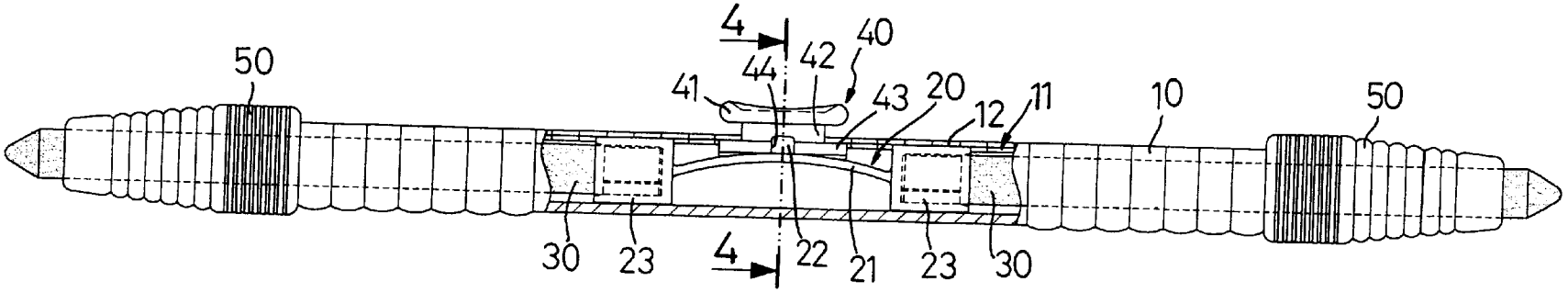
FIG. 2 is a side plan view in partial section of the writing instrument in FIG. 1.
Figure 3:
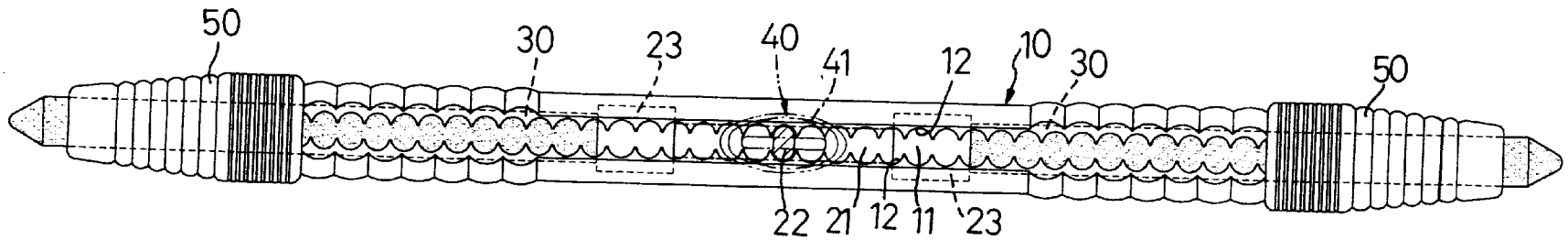
FIG. 3 is a top plan view in partial section of the writing instrument in FIG. 2.
Figure 4:
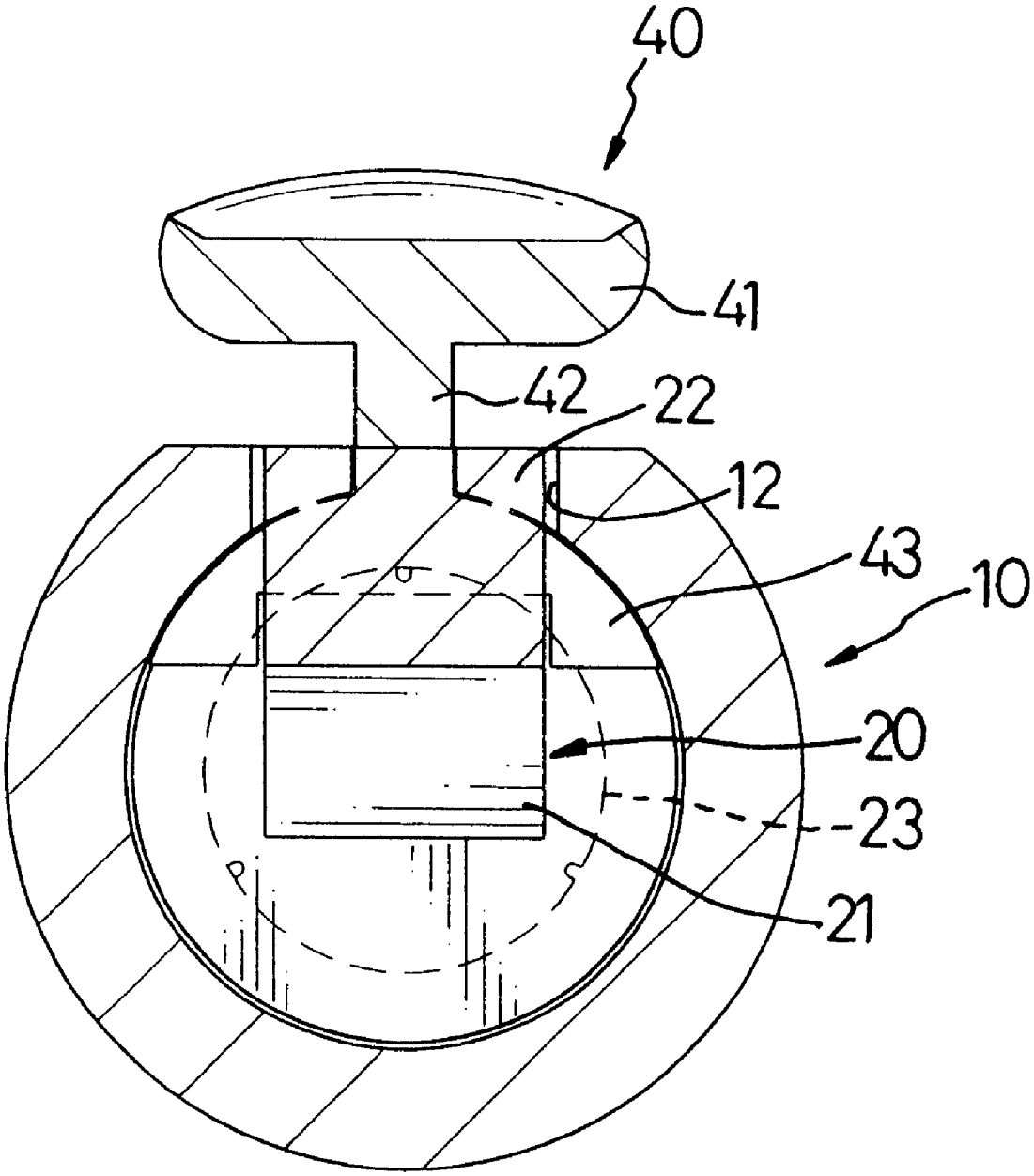
FIG. 4 is a cross sectional end view of the writing instrument along the line 2—2 in FIG. 2.

With reference to the drawings and initially to FIGS. 1 to 3, a writing instrument in accordance with the present invention comprises a hollow barrel (10), a connecting device (20), at least one writing implement (30), a thrust device (40) and two end pieces (50). The barrel (10) has a longitudinal slot (11) that penetrates the wall of the barrel (10). The connecting device (20) is slidably mounted in the barrel (10). One or two writing implements (30) may be attached to the connecting device (20). The thrust device (40) is attached to the connecting device (20) and extends through the slot (11) in the barrel (10). The two end pieces (50) are attached to opposite ends of the barrel (10).

A series of continual, corresponding indentations (12) is defined in each side of the longitudinal slot (11) defined in the outer periphery of the barrel (10).

The connecting device (20) slides longitudinally in the barrel (10) and includes an arcuate resilient plate (21) with a protrusion (22) extending out radially from the center of the plate (21) to be clamped in the corresponding indentations (12) in the slot (11) in the barrel (10). A hollow cylindrical connector (23) is attached to each end of the resilient plate (21). A cavity (231) is defined in the connector (23) and multiple longitudinal ribs (232) are formed on the interior sidewall of the cavity (231). The writing implement (30) is inserted into the cavity (231) and held in place when pressed between the multiple longitudinal ribs (232) so that the writing implement (30) slides in the barrel (10) due to the connecting device (20).

The thrust device (40) includes a slide (43) having a groove (44) defined to receive the protrusion (22) for driving the connecting device (20). The top portion of the slide (43) may be actuate and correspond to the internal shape of the barrel (10). A longitudinal connecting block (42) extends from the slide (43) through the slot (11) of the barrel (10) and is slidably mounted in the slot (I 1) in the barrel (10). A button (41) is attached to the connecting block (42) for the user to push the end of the writing implement (30) out of the end of the barrel (10).

Two end-pieces (50) are respectively attached to the opposite ends of the barrel (10) to limit the range of movement of the thrust device (40). The end-piece (50) is tapered and has a through hole (not numbered) defined in the end of the end-piece (50) to allow the writing implement (30) to extend through the end-piece (50).

Figure 5:
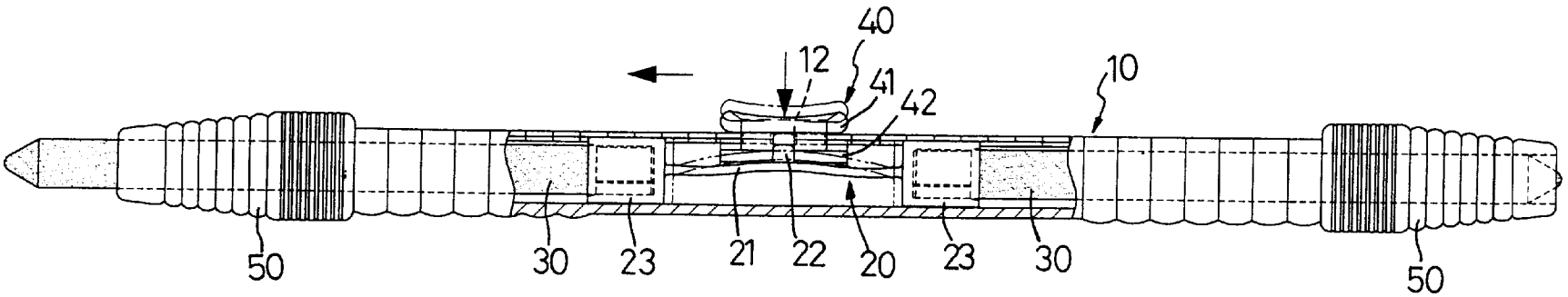
FIG. 5 is an operational side plan view in partial section of the writing instrument in FIG. 1.

With reference to the FIGS. 2 and 5, the protrusion (22) is released from the indentations (12) in the slot (11) of the barrel (10) when the button (41) is pressed down and the slide (43) presses the resilient plate (21) down. Then the user can move the trust device (40) to drive the connecting device (20) back and forth to make the writing implement (30) extend through the end-piece (50) or retract into the barrel (10). The protrusion (22) is clamped in the indentations (12) in the slot (11) of the barrel (10) when the user releases the button (41) due to the restitution force of the resilient plate (21) after the writing implement (30) extends through the end-piece (50) to a suitable length or is fully retacted into the barrel (120). Then the user can effectively use the writing instrument even when the writing implement (30) is very short, and the writing implement (30) will be held firmly in place until the button (41) on the thrust device (40) is pressed.

As described above, the writing instrument in accordance with the present invention has several advantages.

1. The writing implement (30) is well protected in the barrel to solve the problem of breaking the crayon during use.

2. The writing instrument can hold two crayons of different colors. It is convenient to users.

3. An eraser can be used instead of one of the crayons to provide multiple functions to the writing instrument.

4. The crayon can be fully used, and the user's hands never get dirty the crayon because the user holds the barrel when writing or drawing with the crayon.

5. The length of the crayon extending beyond the end of the writing instrument is easily controlled by the displacement of the protrusion.

Although the invention has been explained in relation to its preferred embodiment, it is to be understood that many other possible modifications and variations can be made without departing from the spirit and scope of the invention as hereinafter claimed.

What is claimed is:

1. A writing instrument comprising:

a hollow barrel including a longitudinal slot defined through said barrel; said slot including two sides each having a series of continual indentations defined to correspond to each other;

a hollow cylindrical connecting device longitudinally sliding in said barrel and including an arcuate resilient plate with a center having a protrusion extending out radial from the center of the resilient plate to be clamped in said corresponding indentations in said slot of said barrel, said resilient plate having two opposite ends with a connector attached to each end; said connector having an internal cavity with one open end and multiple longitudinal ribs formed on the interior side wall of said cavity;

at least one writing implement movably received in said barrel and attached to at least one of said connectors of said connecting device; said writing implement inserted into said cavity and held in place by said multiple longitudinal ribs;

a thrust device attached to said connecting device and extending through said slot of side barrel, said thrust device including a slide having a groove defined to receive said protrusion for driving said connecting device and a top portion having a shape corresponding to that of said barrel, a longitudinal connecting block extending from said slide through said slot of said barrel and slidably received in said slot of said barrel, and a button attached to said connecting block for a user to push the end of said writing implement out of said barrel; and two end-pieces respectively attached to opposite ends of said barrel to limit a movement of said trust device, said end-pieces each having a through hole defined in the end to allow said writing implement to extend through the through hole and out of the barrel.

2. The writing instrument as claimed in claim 1, wherein said writing implement is a crayon.

3. The writing instrument as claimed in claim 1, wherein said writing implement is a colored pencil.

4. The writing instrument as claimed in claim 1, wherein said writing implement is an eraser stick.

* * * * *